US007384043B2

(12) United States Patent
Giese

(10) Patent No.: US 7,384,043 B2
(45) Date of Patent: Jun. 10, 2008

(54) IMAGING APPARATUS WITH SHEET TRANSPORT SYSTEM EMPLOYING CAM ACTUATING SYSTEM

(75) Inventor: Troy A. Giese, North Hugo, MN (US)

(73) Assignee: Carestream Health, Inc., Rochester, NY (US)

( * ) Notice: Subject to any disclaimer, the term of this patent is extended or adjusted under 35 U.S.C. 154(b) by 257 days.

(21) Appl. No.: 11/029,552

(22) Filed: Jan. 5, 2005

(65) Prior Publication Data

US 2006/0145416 A1 Jul. 6, 2006

(51) Int. Cl.
*B65H 5/02* (2006.01)

(52) U.S. Cl. ..... 271/273; 271/274; 74/48; 74/50; 198/624

(58) Field of Classification Search ..... 271/273, 271/274; 74/50, 48; 198/624
See application file for complete search history.

(56) References Cited

U.S. PATENT DOCUMENTS 4,888,617 A 12/1989 Okuzawa
5,004,217 A 4/1991 Kano et al.
5,052,677 A 10/1991 Shibata
5,453,852 A 9/1995 Morikawa et al.
5,510,909 A 4/1996 Morikawa et al.
5,630,583 A 5/1997 Yergenson
5,862,447 A 1/1999 Matsumura
5,983,066 A 11/1999 Abe et al.
5,984,297 A 11/1999 Tanaka
6,513,805 B2 2/2003 Takida et al.
6,929,261 B2 * 8/2005 Nelson et al. ..... 271/273
2004/0169330 A1 9/2004 Nelson et al.

* cited by examiner

*Primary Examiner*—Kaitlin Joerger

(57) ABSTRACT

An actuator system for use with a sheet transport system having a first roller and a second roller. The actuator system includes an idler assembly and a drive assembly. The idler assembly is coupled to the first roller and is biased to hold the first roller in a closed position engaging the second roller for transporting a sheet. The drive assembly is configured to engage the idler assembly to move the first roller between an open position spaced from the second roller and the closed position and to disengage the idler assembly when the first roller is in the closed position so that the first roller is held in the closed position solely by the idler assembly.

11 Claims, 10 Drawing Sheets

IMAGING APPARATUS WITH SHEET TRANSPORT SYSTEM EMPLOYING CAM ACTUATING SYSTEM

FIELD OF THE INVENTION

The present invention relates generally to an imaging apparatus, and more specifically to an imaging apparatus having a sheet transport system employing a cam actuating system.

BACKGROUND OF THE INVENTION

Laser images are widely used in the medical imaging field to produce visual representations on film of digital medical images. Laser imagers typically include a film supply system, a film exposure system, a film processing system, and a transport system that moves film from the film supply through the laser imager along a transport path. The film supply system generally comprises a supply of unexposed film stacked in a cartridge or magazine. The transport system typically includes a mechanism for removing individual sheets of film from the cartridge, and a feeder system for delivering the individual sheets of film to the transport path along which the film is transported through the film exposure and processing systems to an output tray for access by a user.

When transferring the individual sheets of film to the transport path, it is important that the film be properly delivered to the transport path. A piece of film that is delivered at an angle, or skewed, relative to the direction of travel along the transport path can cause an image to be improperly produced on the film and cause film jams along the transport path.

One type of feeder system includes a drive roller and an idler roller that together form a feed roller pair for receiving an individual sheet of film after its removal from the film supply. Initially, the idler roller is held out of contact with the drive roller. Upon a sheet of film being placed in contact with the drive roller, a gear drive system, which is coupled to each end of the idler roller with a pair of spring-loaded links, drives the idler roller to a closed position to secure the film between the idler roller and the drive roller. The drive roller is then driven to transport the film away from the film supply to the transport path.

In the closed position, the spring-loaded links are designed to provide closing pressure between the two rollers. However, since the gear drive system is directly coupled to the idler roller via the spring loaded links, the gear drive system continues to influence the closing pressure between the idler roller and drive roller when in the closed position. During assembly, the gear drive system can be improperly installed, resulting in an uneven closing of the idler roller against the drive roller. In such an instance, the closing pressure can vary between the ends of the rollers, resulting in the film becoming skewed as it is delivered from the film supply to the transport path.

Thus, there is a need for an improved feeder system for delivering film from a film supply to a transport path in an imaging apparatus.

SUMMARY OF THE INVENTION

In one embodiment, the present invention provides an actuator system for use with a sheet transport system having a first roller and a second roller, the actuator system including an idler assembly and a drive assembly. The idler assembly is coupled to the first roller and biased to hold the first roller in a closed position engaging the second roller for transporting a sheet. The drive assembly is configured to engage the idler assembly to move the first roller between an open position spaced from the second roller and the closed position, and to disengage from the idler assembly when the first roller is in the closed position so that first roller is held in the closed position solely by the idler assembly.

In one embodiment, the idler assembly comprises a pair of a spring-driven idler cams, each idler cam rotatably coupled to opposite ends of the first roller and biased to provide a substantially same closing force at the opposite ends of the idler roller so as to maintain a uniform closing pressure independent of the drive assembly between the ends of the first roller and the second roller when the first roller is in the closed position. In one embodiment, the idler assembly includes a pair of torsion springs, each torsion spring engaging and biasing a different one of the idler cams so as to hold the idler roller in the closed position, wherein the torsion springs are configured to have a near maximum spring force when the idler roller is in the open position.

In one embodiment, the drive assembly includes a pair of drive cams configured to rotate in tandem about an axis, each drive cam configured to engage a different one of the pair of idler cams and to cause the idler cams to rotate so as to move the first roller between the open position and the closed position, wherein the pair of drive cams disengages the pair of idler cams when the first roller is in the closed position. In one embodiment, each of the drive cams includes a cam dwell in contact with the corresponding idler cam when the first roller is in the open position.

By eliminating contact between the drive assembly and idler assembly when the idler roller is in the closed position with the drive roller, the actuator system according to the present invention ensures that the torsion springs of the idler assembly provide the sole source of closing pressure between the idler and drive rollers. This increases the likelihood of even closing pressure between the ends of the idler roller and the drive roller and thereby substantially reducing the potential for film skew. Furthermore, by incorporating a cam dwell in the open position, unwanted rotation of the drive cams when the idler cam is in the open position is substantially eliminated and provides a more tolerant design.

DETAILED DESCRIPTION OF THE INVENTION

Figure 1:
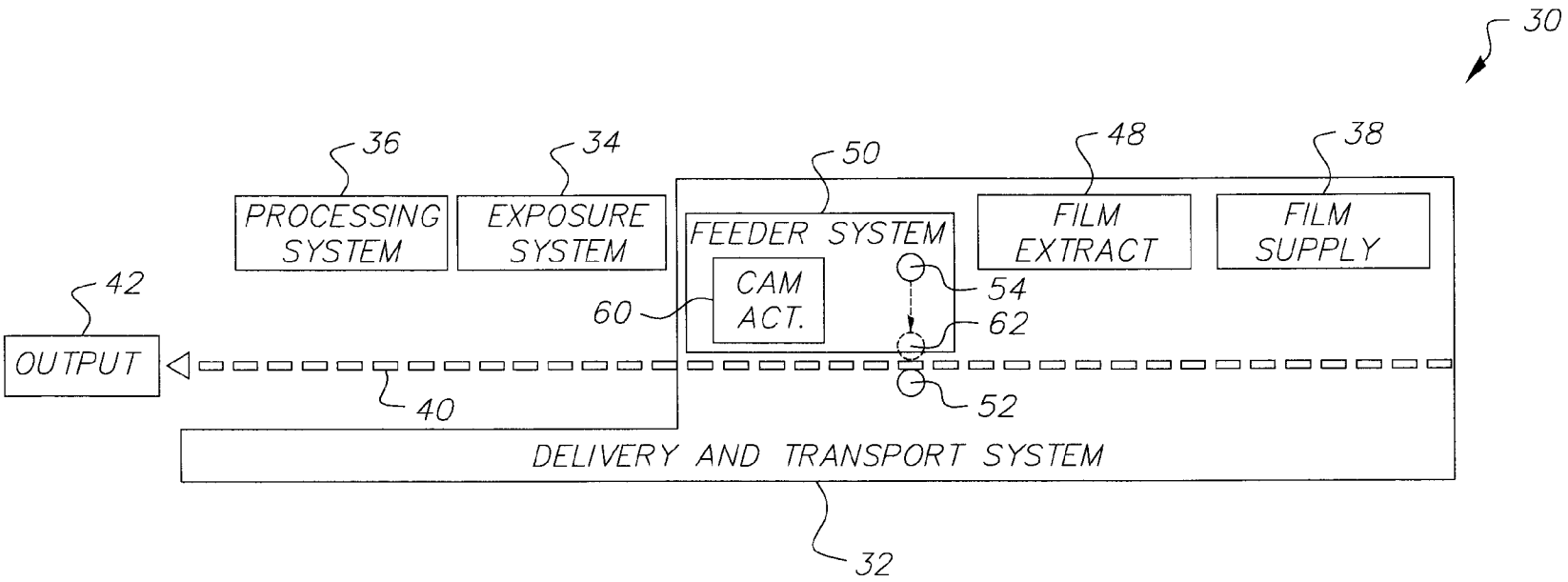
FIG. 1 is a block diagram illustrating generally an imaging apparatus employing a cam actuating system according to the present invention.

FIG. 1 is a block diagram illustrating generally an imaging apparatus 30 employing a cam actuating system according to embodiments of the present invention. Imaging apparatus 30 includes a film delivery and transport system 32, a film exposure system 34, and a film processing system 36, with delivery and transport system 32 further including a film supply 38 or a film source 38.

Delivery and transport system 32 transports unexposed film from film supply 38 along a transport path 40 to film exposure system 34 that exposes the film to light representative of a desired image to create a latent image of the desired image in the film. In one embodiment, film exposure system 34 comprises a laser scanning module.

Delivery and transport system 32 then moves the exposed film along transport path 40 to film processing system 36. In one embodiment, film processing system 36 comprises a thermal processor, such as a drum-type processor, which heats the exposed film to thermally develop the latent image. The developed film is then moved by delivery and transport system 32 to an output area 42, such as an output tray, for access by a user. An example of an imaging apparatus similar to that described generally above by imaging apparatus 30 is described by U.S. Pat. No. 6,007,971 to Star et al., which is herein incorporated by reference.

In one embodiment, film supply 38 comprises a supply of unexposed film stacked in a cartridges or magazine, with delivery and transport system 32 including a film extractor 48 for removing individual sheets of unexposed film from the cartridge. Delivery and transport system 32 further includes a feeder system 50, which receives and delivers the individual sheets of film from film extractor 48 to transport path 40 for subsequent transport through imaging apparatus 30. Feeder system 50 includes a drive roller 52, an idler roller 54, and a cam actuating system 60 in accordance with the present invention for moving idler roller 54 between an open position, as illustrated, and a closed position 62 with drive roller 52 for receiving an individual sheet of film from film extractor 48.

Figure 2:
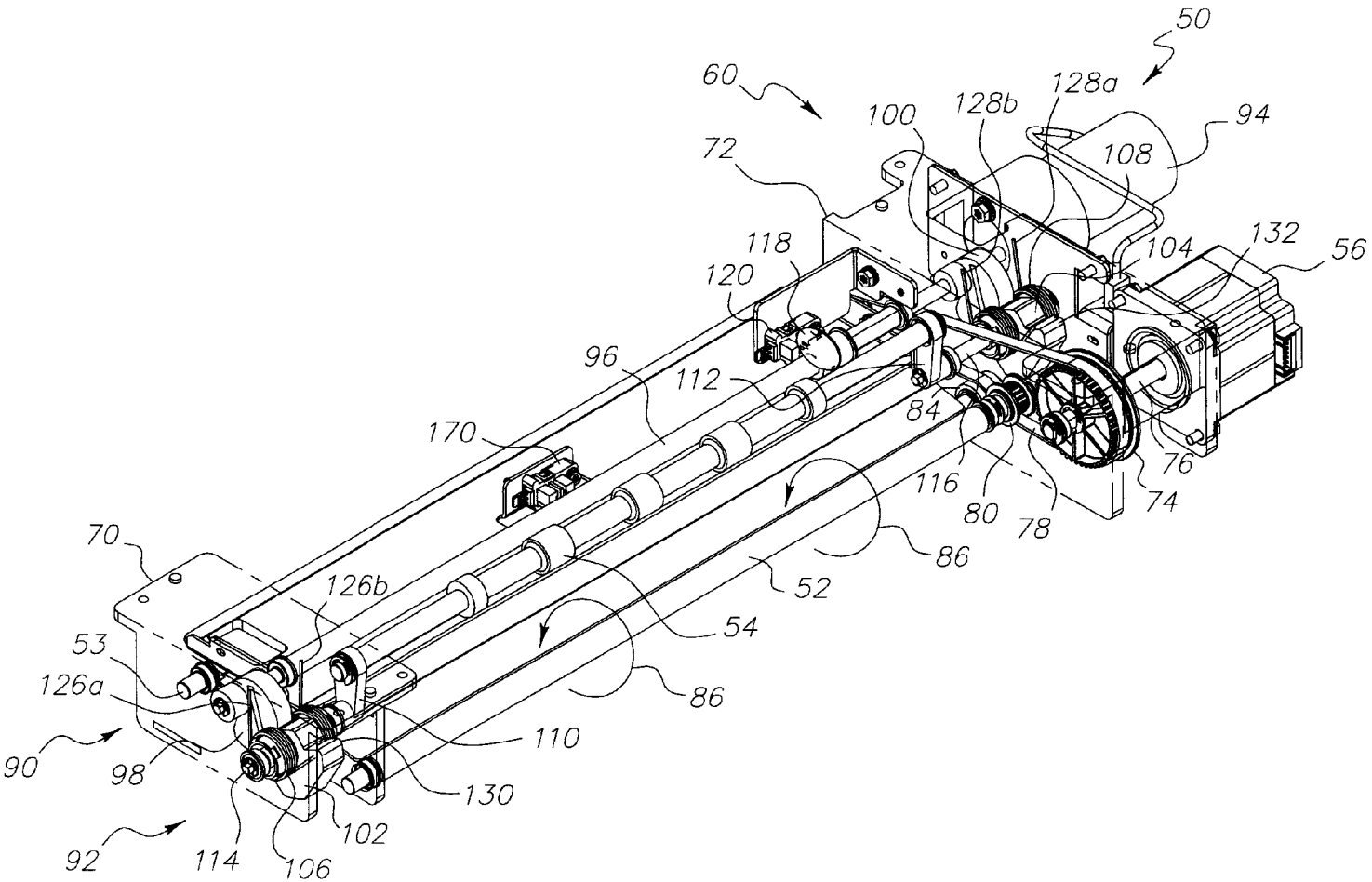
FIG. 2 is an isometric view illustrating one implementation of a feeder assembly employing one exemplary embodiment of a cam actuating system according to the present invention.

FIG. 2 is an isometric view illustrating one implementation of feeder system 50 employing a cam actuating system 60 in accordance with the present invention. Feeder system 50 includes first stationary drive roller 52, a second stationary drive roller 53, movable idler roller 54, a stepper motor 56, and a cam actuating system 60, according to one exemplary embodiment of the present invention, configured to move idler roller 54 between an open position spaced from drive roller 52 and a closed position engaging drive roller 52 for transporting film. The ends of stationary drive rollers 52, 53 are rotatably mounted with bearings to a front mount structure 70 and a rear mount structure 72, both of which are indicated by dashed lines.

A pulley 74 is mounted to a shaft 76 of stepper motor 56. A toothed belt 78 is wrapped around pulley 74 and around two drive pulleys 80, 82 keyed to the ends of drive rollers 52, 53 proximate to rear mount structure 72. Only drive pulley 80 coupled to the end of drive roller 52 is shown in FIG. 1. Toothed belt 78 is tensioned using a fixed idler pulley 84. When driven in a counter-clockwise direction by stepper motor 56, pulley 74 and toothed belt 78 cause drive pulleys 80, 82 and drive rollers 52, 53 to rotate in a counter-clockwise direction as well, as indicated by rotational arrow 86.

Cam actuating system 60 includes a drive assembly 90 and an idler assembly 92. Drive assembly 90 includes a drive motor 94, a drive shaft 96, and a pair of drive cams 98, 100. Idler assembly 92 includes a pair of idler cams 102, 104, a pair of double-ended torsion springs 106, 108, a pair of idler links 110, 112, and a pair of idler shafts 114, 116. Drive shaft 96 is rotatably mounted via bearings proximate to each end to front mount structure 70 and rear mount structure 72, with one end (as illustrated, the end proximate to rear mount structure 72) coupled to drive motor 94. Drive cams 98, 100 are fixed-mounted proximate to opposite ends of drive shaft 96, with drive cams 98, 100 and drive shaft 96 being keyed so that drive cams 98, 100 are in rotational alignment with one another. Cam actuating system 60 further includes a flag element 118 fixed-mounted to drive shaft 96 and an interrupt sensor 120 mounted to rear mount structure 72 which are together configured to monitor a rotational position of drive shaft 96 and drive cams 98, 100.

Figure 3:
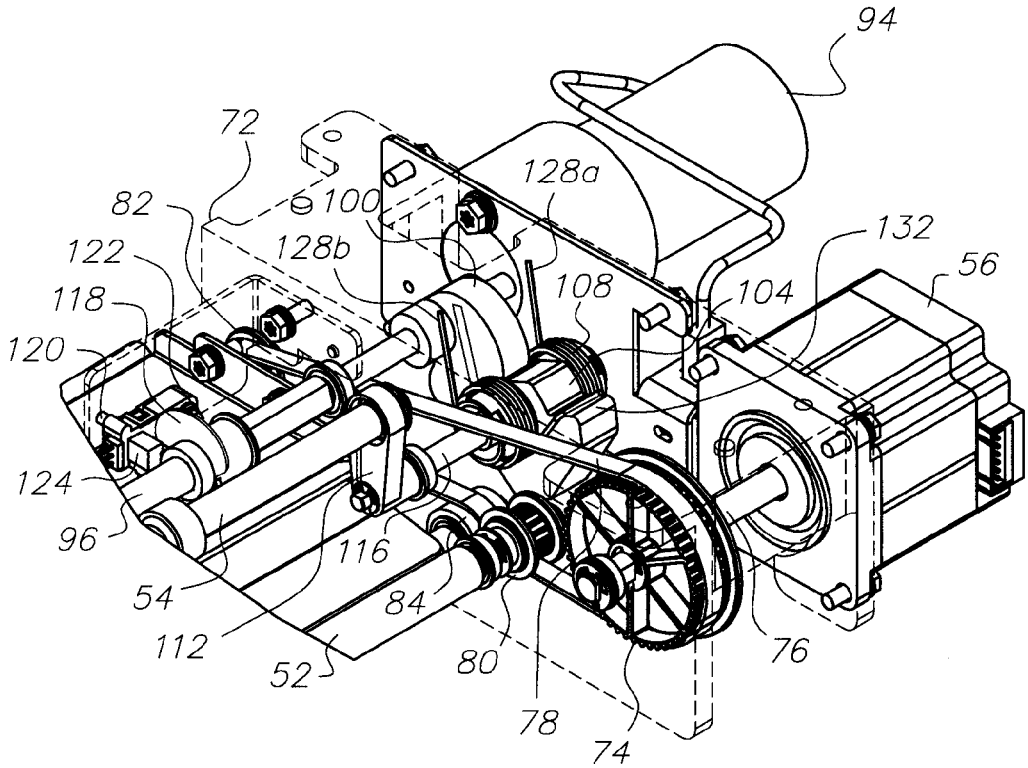
FIG. 3 is an enlarged isometric view illustrating portions of the feeder assembly and cam actuating system illustrated by FIG. 2.

FIG. 3 is an enlarged view illustrating a portion of feeder assembly 30 illustrated by FIG. 1. In this view, drive pulley 82 keyed to the end of drive roller 53 (not visible in the view shown) is illustrated. In one embodiment, as illustrated, interrupt sensor 120 comprises an optical sensor having a light source 122 spaced from and in optical alignment with an optical receiver 124. Flag element 118 is positioned on drive shaft 96 such that flag element 118 interrupts the optical path between light source 122 and optical receiver 124 as drive shaft 96 rotates.

Returning to FIG. 2, idler shafts 114 and 116 are rotatably mounted via bearings to front mount structure 70 and rear mount structure 72, respectively. Idler cams 102 and 104 are fixed-mounted respectively to idler shafts 114 and 116. Similarly, one end of each idler link 110 and 112 is fixed-mounted respectively to idler shafts 114 and 116. Opposite ends of idler roller 54 are rotatably coupled via bearings to opposing idler links 110 and 112 such that idler shaft 114 can rotate relative to idler links 110, 112. Idler cams 102, 104 and idler links 110, 112 are keyed respectively to idler shafts 114 and 116 such that idler cam 102 and idler link 110 are rotationally aligned with idler cam 104 and idler link 112 relative to idler roller 54.

Double-ended torsion springs 106 and 108 are axially mounted respectively about idler shafts 114 and 116. A pair of legs 126*a*, 126*b* of torsion spring 106 and a pair of legs 128*a*, 128*b* of torsion spring 108 are selectively coupled to front mount structure 70 and rear mount structure 72, respectively. Double-ended torsion springs 106 and 108 respectively include saddle elements 130 and 132 engaging idler cams 102 and 104.

Figure 4:
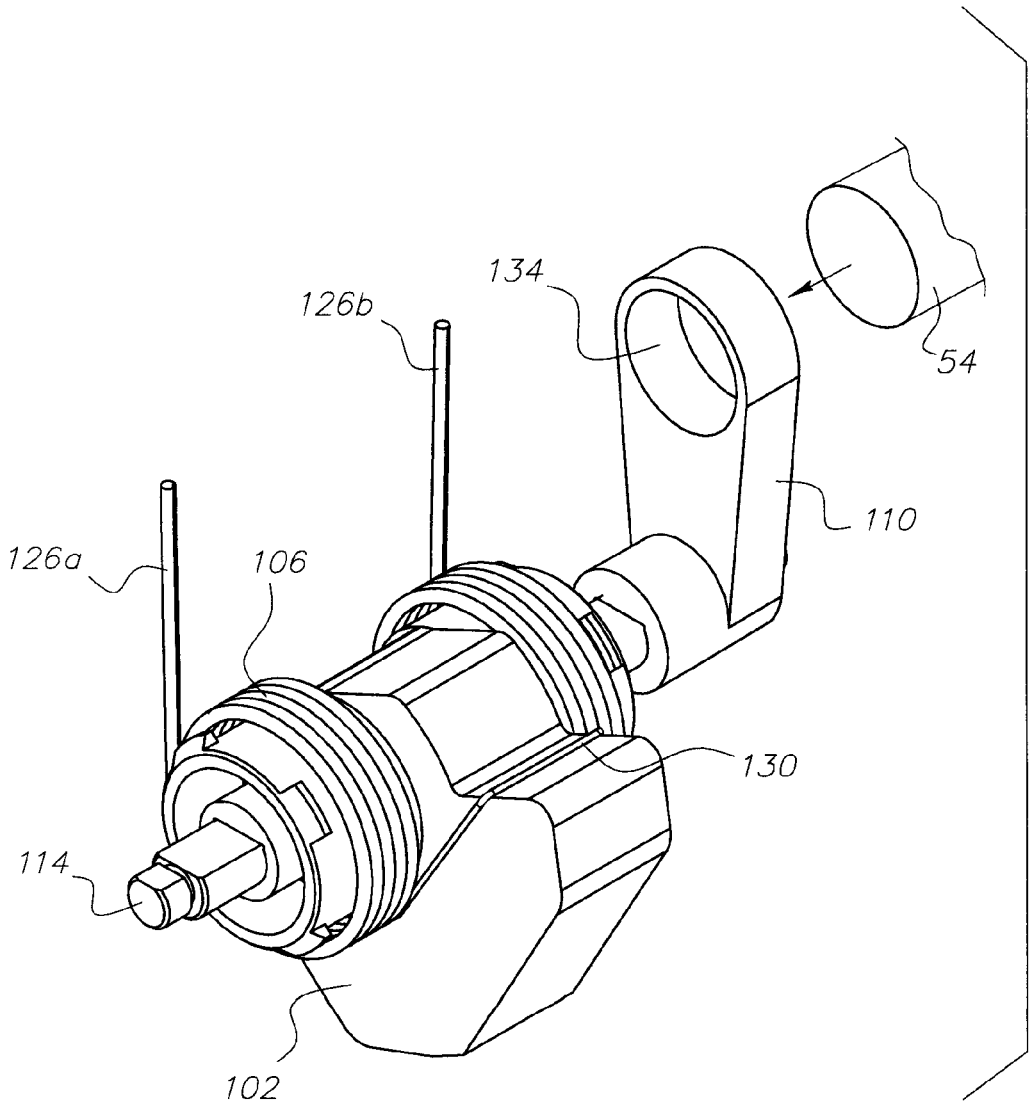
FIG. 4 is an enlarged isometric view illustrating portions of the cam actuating system of FIG. 2.

FIG. 4 is an enlarged isometric view illustrating in greater detail a idler cam 102, torsion spring 106, and idler link 110 of idler assembly 92. As illustrated, idler link 110 includes an opening 134 into which idler roller 54 is rotatably coupled via bearings and free to rotate relative to idler link 110. Although not illustrated, idler link 112 includes a similar opening adapted to rotatably couple to the other end of idler roller 54.

Figure 5:
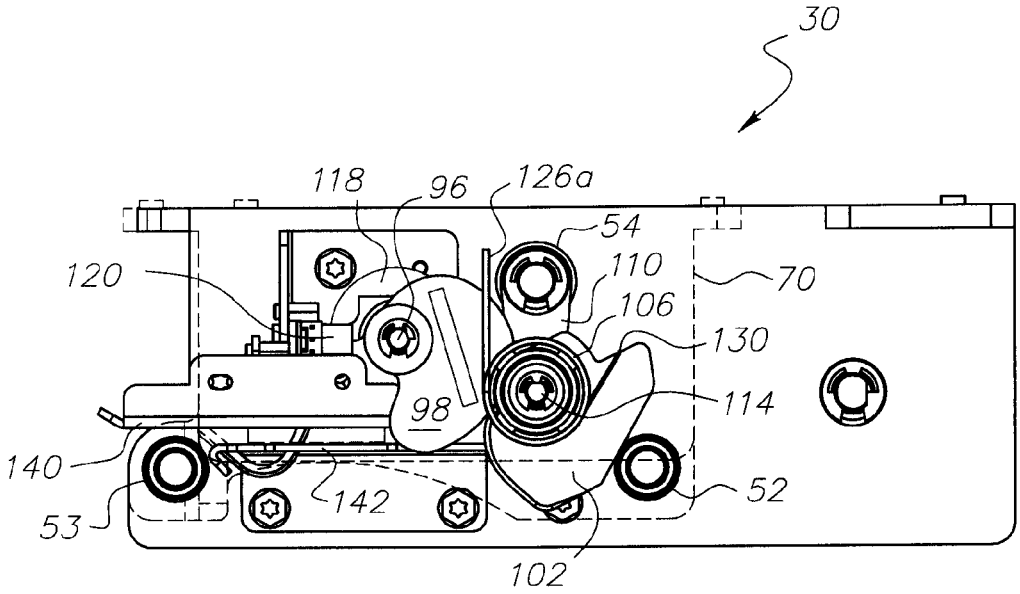
FIG. 5 is a cross-sectional view of the feeder assembly of FIG. 2.

FIG. 5 is an end view of feeder system 50 of FIG. 2, illustrating the relationship between drive rollers 52, 53, drive assembly 90, and idler assembly 92. As illustrated, feeder system 50 further includes a pair of spaced guide plates 140, 142 for guiding a sheet of film driven by drive rollers 52, 53 along a transport path, such as transport path 40, to a downstream component of imaging apparatus 30, such as exposure system 34.

Figure 6A:
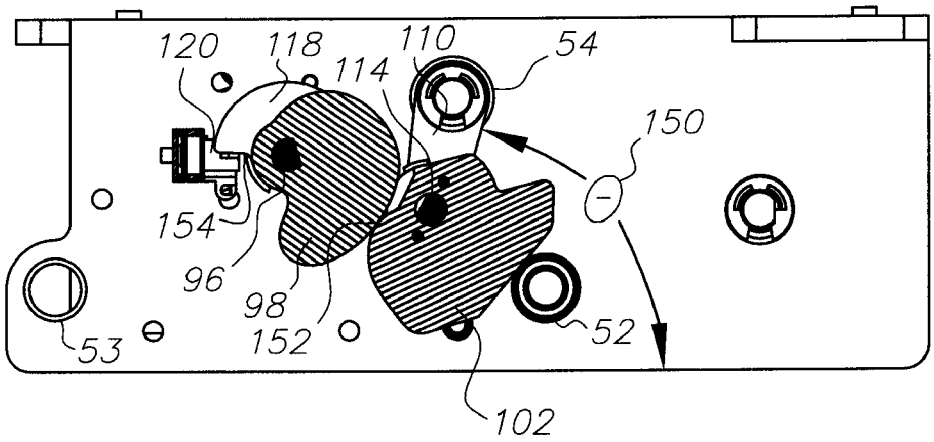
FIG. 6A is an end view of the feeder assembly of FIG. 2 illustrating portions of and demonstrating the operation of the cam drive assembly.

FIGS. 6A through 6E illustrate the operation of a portion of a cam actuating system 60. FIG. 6A illustrates cam actuating system 60 in a full-open, or "home," position, where the idler link 110, which is fixed-mounted to idler shaft 114, has been rotated to a position at a maximum angle (θ) 150 from horizontal. In one embodiment, maximum angle 150 is approximately 74 degrees. With idler link 110 biased to its maximum open position, the closing force of torsion spring 106 (FIG. 2) is at its maximum when cam actuating system 60 is in the home position.

Drive cam 98 is configured with a "cam dwell" in the home position. A cam dwell is a section of a cam having a portion including a constant radius from a center of rotation. In this case, drive cam 98 has a constant radius from drive shaft 96 on either side of a contact point 152 with idler cam 102 when in the home position. Therefore, even though drive 98 and idler cam 102 are in contact with one another in the home position and the closing force of torsion spring is at its maximum, the cam dwell substantially eliminates load on drive motor 94 (FIG. 3) and prevents unwanted rotation of drive cam 98 and idler cam 102 when motor 94 is idle.

Flag element 118 has an arcuate shape having a first edge 154 and a second edge 156 (see FIG. 6D and FIG. 6E), with the position of each edge 154, 156 relative to sensor 120 corresponding to a position of the idler roller 54 relative to drive roller 52. Cam actuating system 60 employs a state change of sensor 120 (i.e. light transmitted from-light source 122 (FIG. 3) to receiver 124 (FIG. 3) changing from a blocked to an unblocked position, or vice-versa) to determine a position of cam actuating system 60. In the embodiment illustrated by FIG. 6A, first edge 154 of flag element 118 is positioned just above sensor 120 when cam actuating system 60 is in the home position, such that sensor 120 is "unblocked" and light is free to travel from light source 122 to receiver 124.

The home position is the position of cam actuating system 60 when feeder system 30 is waiting to receive a sheet of film via drive roller 52 and idler roller 54, such as from film extractor 48. Upon extracting a sheet of film from film supply 38, film extractor 48 positions the sheet of film between drive roller 52 and idler roller 54 and notifies feeder system 50 that a sheet of film has been delivered.

Figure 6B:
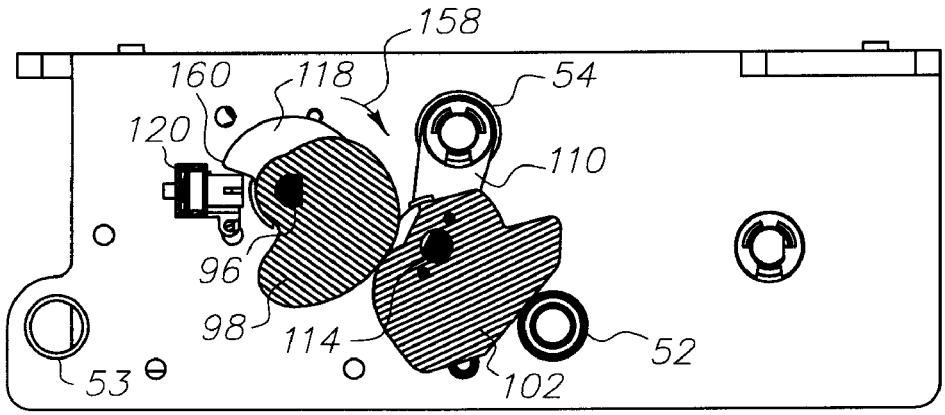
FIG. 6B is an end view of the feeder assembly of FIG. 2 illustrating portions of and demonstrating the operation of the cam drive assembly.

Referring also to FIG. 6B, upon receiving the sheet of film, drive motor 94 (FIG. 3) begins to turn drive shaft 96 in a clockwise direction, as illustrated by rotational arrow 158. FIG. 6B illustrates drive cam 98 rotated slightly off the home position. As drive shaft 96 begins to rotate, drive cam 98 and flag element 118 also begin to rotate in clockwise direction 158, causing first edge 154 of flag element 118 to rotate further away from sensor 120, as indicated by the gap at 160. Note, however, that because of the cam dwell, even though drive cam 98 has begun to rotate, idler cam 102 and, thus, idler link 110 and idler roller 54, have not yet begun to rotate.

Figure 6C:
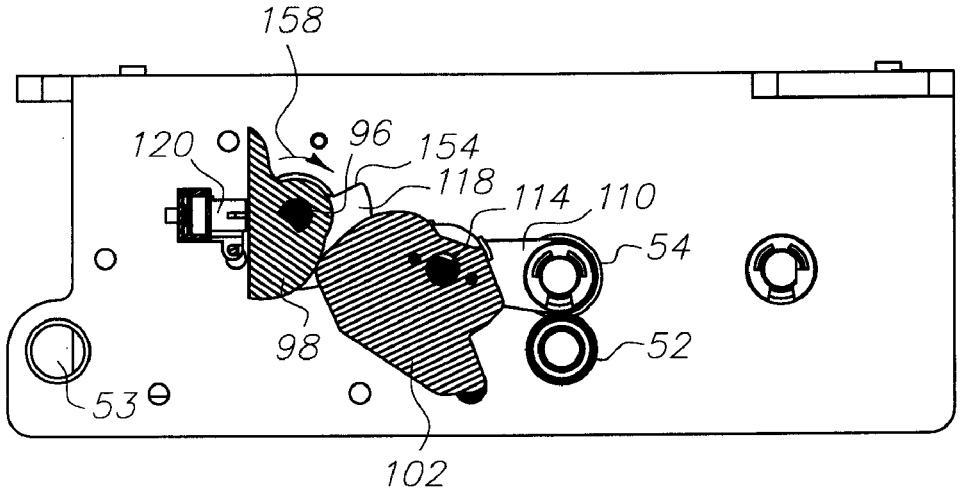
FIG. 6C is an end view of the feeder assembly of FIG. 2 illustrating portions of and demonstrating the operation of the cam drive assembly.

Referring also to FIG. 6C, as drive cam 98 continues to be rotated in clockwise direction 158 by drive motor 94 (FIG. 3), drive cam 98 and idler cam 102 exit the cam dwell region and the closing force of torsion spring 106 (FIG. 2) causes idler cam 102 and thus, idler link 110 and idler roller 54 to rotate in a clockwise direction as well. FIG. 6C illustrates an "intermediate" closed position where idler cam 102 has rotated to a position of initial contact between drive roller 52 and idler roller 54. Note that drive cam 98 and idler cam 102 remain in contact in this position, with drive assembly 90 thus influencing the position of idler roller 54 and the closing pressure between drive roller 52 and idler roller 54.

Figure 6D:
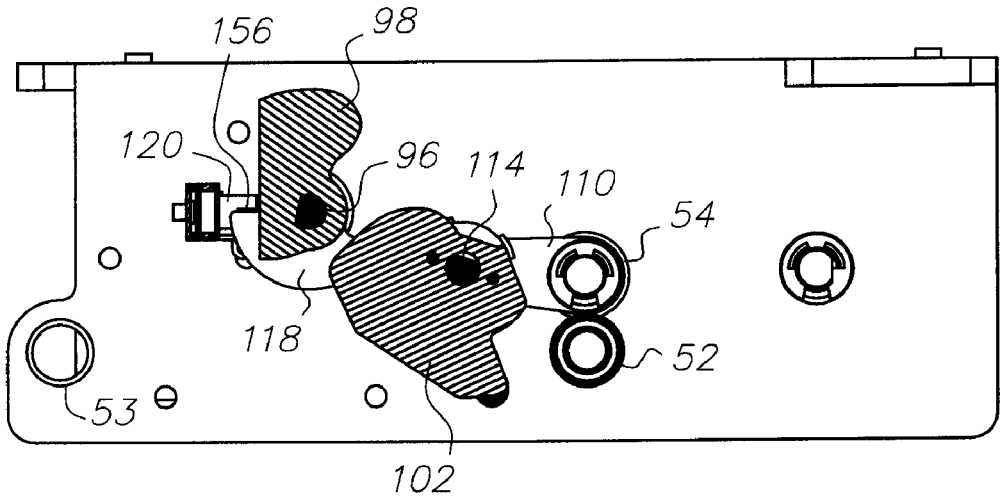
FIG. 6D is an end view of the feeder assembly of FIG. 2 illustrating portions of and demonstrating the operation of the cam drive assembly.

Referring also to FIG. 6D, as drive cam 98 continues to be rotated in clockwise direction 158 by drive motor 94 (FIG. 3), drive cam 98 and idler cam 102 separate from one another and enter a "zero contact" region. Drive motor 94 continues to rotate drive cam 98 in clockwise direction 158 until the second edge 156 of flag element 118 reaches interrupt sensor 120 and interrupts the transmission of light from light source 122 to optical receiver 124. In other words, the state of interrupt sensor 120 has gone from an "unblocked" (see. FIG. 6A) to a "blocked" state, at which point drive motor 94 (FIG. 3) stops rotating drive cam 98. FIG. 6D illustrates cam actuating system 60 in a "closed" position, wherein drive roller 52 and idler roller 54 are held in contact with one another solely through the closing force of torsion springs 106, 108 (FIG. 2). Since there is no contact between drive assembly 90 and idler assembly 92 when cam actuating system is in the closed position, contact between drive roller 52 and idler roller 54 cannot be influenced by drive assembly 90. This ensures that torsion springs 106, 108 provide independent and uniform closing pressure of idler roller 54 against each end of drive roller 52, thereby substantially reducing film skew resulting from uneven mating between drive roller 52 and idler roller 54.

At this point, stepper motor 56 begins turning drive rollers 52, 53 to feed the sheet of imaging material from the film supply, such as film supply 38, through feeder system 50 to the next component of the imaging apparatus 30, such as exposure system 34. Feeder system 50 further includes a film supply sensor 170 (see FIG. 2) that detects both the leading edge and the trailing edge of the film to ensure that the film has successfully entered feeder system 50 from film supply 38 and has successfully exited feeder system 50 and been delivered to exposure system 34.

Figure 6E:
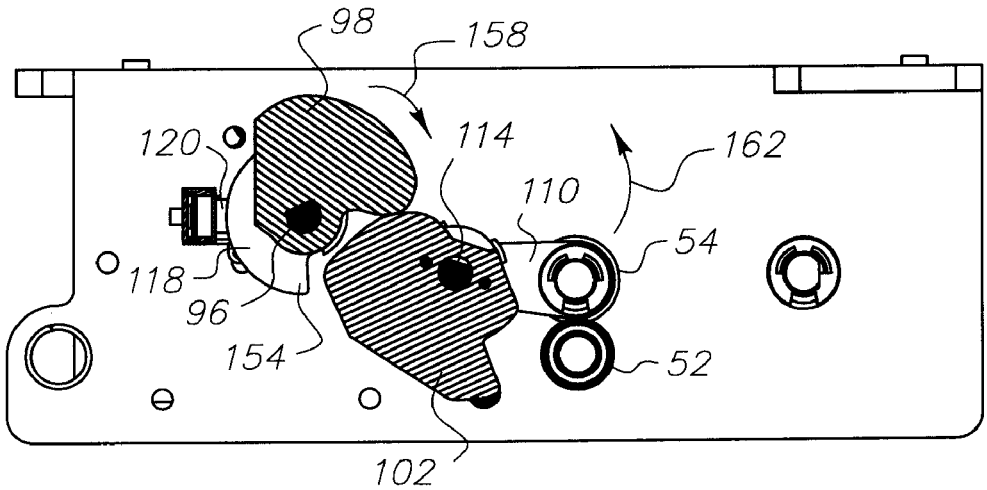
FIG. 6E is an end view of the feeder assembly of FIG. 2 illustrating portions of and demonstrating the operation of the cam drive assembly.

Referring also to FIG. 6E, upon successful delivery of the film to the downstream component, such as exposure system 34, stepper motor 56 stops driving drive roller 52, 53 and drive motor 94 begins rotating drive cam 98 in clockwise direction 158 until drive cam 98 once again contacts idler cam 102. Drive motor 94 (FIG. 3) continues to rotate drive cam 98 in clockwise direction 158, causing idler cam 102 and idler link 110 to rotate idler roller 54 in a direction 162 away from drive roller 52 and back toward the open position. Drive motor 94 continues to rotate drive cam 98 in clockwise direction 158 until the first edge 154 of flag element 118 passes by interrupt sensor 120 such that light source 122 can again freely transmit light to optical receiver 124. In other words, the state of interrupt sensor has gone from a "blocked" (see FIG. 6A) to an "unblocked" state, at which point drive motor 94 stops rotating drive cam 98 and cam actuating system 60 is once again in the full-open, or home, position as depicted by FIG. 6A.

The process described above by FIGS. 6A through 6E is repeated for each sheet of film received from film supply 38 and film extractor 48. Although FIGS. 6A through 6E and the related description primarily describe the operation of drive cam 98, idler cam 102, torsion spring 106, and idler link 110, drive cam 100, idler cam 104, torsion spring 108, and idler link 112 operate in a similar fashion. Furthermore, although drive assembly 90 was described above as operating in a clockwise direction 158, cam actuating system 60 can also operate with drive assembly 90 operating in a counterclockwise direction.

In summary, by maintaining zero contact between drive assembly 90 and idler assembly 92 when idler roller 54 is in contact with drive roller 52 and feeder system 50 is transporting a sheet of film, such as from film extractor 48 to film exposure system 34 of imaging apparatus 30, cam actuating system 60 according to the present invention ensures that torsion springs 106 and 108 are providing the sole source of closing pressure between idler roller 54 and drive roller 52, thereby ensuring even pressure distribution axially along the rollers and substantially reducing the potential for film skew. Furthermore, by incorporating a cam dwell in the open position, cam actuating system 60 substantially reduces and/or eliminates load on drive motor 94 and prevents unwanted rotation of drive cam 98 and idler cam 102 when motor 94 is idle, and provides a more tolerant design.

All documents, patents, journal articles and other materials cited in the present application are hereby incorporated by reference.

The invention has been described in detail with particular reference to certain preferred embodiments thereof, but it will be understood that variations and modifications can be effected within the spirit and scope of the invention.

PARTS LIST

| | |
|---|---|
| 30 | Imaging Apparatus |
| 32 | Film Delivery and Transport System |
| 34 | Film Exposure System |
| 36 | Film Processing System |
| 38 | Film Supply |
| 40 | Transport Path |
| 42 | Output Tray |
| 48 | Film Extractor |
| 50 | Feeder System |
| 52, 53 | Drive Rollers |
| 54 | Idler Roller |
| 56 | Stepper Motor |
| 60 | Cam Actuating System |
| 62 | Closed Position |
| 70 | Front Mount Structure |
| 72 | Rear Mount Structure |
| 74 | Pulley |
| 76 | Shaft - Stepper Motor |
| 78 | Toothed Belt |
| 80, 82 | Drive Pulley |
| 84 | Idler Pulley |
| 86 | Rotational Arrow |
| 90 | Drive Assembly |
| 92 | Idler Assembly |
| 94 | Drive Motor |
| 96 | Drive Shaft |
| 98, 100 | Drive Cams |
| 102, 104 | Idler Cams |
| 106, 108 | Torsion Springs |
| 110, 112 | Idler Links |
| 114, 116 | Idler Shafts |
| 118 | Flag Element |
| 120 | Interrupt Sensor |
| 122 | Light Source |
| 124 | Optical Receiver |
| 126a, 126b | Spring Legs |
| 128a, 128b | Spring Legs |
| 130, 132 | Torsion Spring - Saddle Elements |
| 134 | Opening in Idler Link |
| 140, 142 | Guide Plates |
| 150 | Angle |
| 152 | Contact Point - Drive Cam and Idler Cam |
| 154 | Flag Element - First Edge |
| 156 | Flag Element - Second Edge |
| 158 | Directional Arrow |

-continued

PARTS LIST

| | |
|---|---|
| 160 | Gap Between Interrupt Sensor and Flag Element |
| 162 | Directional Arrow |
| 170 | Film Supply Sensor |

What is claimed is:

1. An actuator system for use with a sheet transport system having a first roller and a second roller, the actuator system comprising:

an idler assembly coupled to the first roller and biased to hold the first roller in a closed position engaging the second roller for transporting a sheet; and a drive assembly configured to engage the idler assembly to move the first roller between an open position spaced from the second roller and the closed position and to disengage from the idler assembly when the first roller is in the closed position so that first roller is held in the closed position solely by the idler assembly;

wherein the idler assembly includes a pair of a spring-driven idler cams, each idler cam rotatably coupled to an opposite end of the first roller and biased to provide a substantially same closing force at the opposite ends of the first roller so as to maintain a uniform closing pressure independent of the drive assembly between the ends of the first roller and the second roller when the first roller is in the closed position; and wherein the idler assembly further comprises:

a pair of idler shafts rotatably mounted to the sheet transport system and spaced apart along an axis, wherein each idler cam is axially mounted to a different one of the idler shafts;

a pair of idler links, each idler link having a first end axially mounted to a different one of the idler shafts and a second end rotatably coupled to the opposite ends of the first roller; and a pair of torsion springs, each torsion spring axially mounted about a different one of the idler shafts and configured to engage the associated idler cam so that the pair of torsion springs bias the idler cams so as to hold the first roller in the closed position.

2. The actuator system of claim 1, wherein the first roller is an idler roller and the second roller is a drive roller.

3. The actuator system of claim 1, wherein the idler assembly includes a pair of a spring-driven idler cams, each idler cam rotatably coupled to an opposite end of the first roller and biased to provide a substantially same closing force at the opposite ends of the first roller so as to maintain a uniform closing pressure independent of the drive assembly between the ends of the first roller and the second roller when the first roller is in the closed position.

4. The actuator system of claim 1, wherein each of the torsion springs is configured to have a near maximum spring force when the drive assembly moves the first roller to the open position.

5. The actuator system of claim 1, wherein the idler cams and idler links are keyed to the corresponding idler link such that when the idler links are coupled to the opposite ends of the first roller, the idler cams and idler links are radially aligned along the axis.

6. The actuator system of claim 1, wherein the actuator system includes a flag element coupled to the drive assembly, the flag element being indicative of the position of the first roller.

7. The actuator system of claim 1, wherein the flag element includes a first edge representative of the first roller being in the closed position and a second edge representative of the first roller being in the open position.

8. An actuator system for use with a sheet transport system having a first roller and a second roller, the actuator system comprising:

an idler assembly coupled to the first roller and biased to hold the first roller in a closed position engaging the second roller for transporting a sheet; and a drive assembly configured to engage the idler assembly to move the first roller between an open position spaced from the second roller and the closed position and to disengage from the idler assembly when the first roller is in the closed position so that first roller is held in the closed position solely by the idler assembly;

wherein the idler assembly includes a pair of a spring-driven idler cams, each idler cam rotatably coupled to an opposite end of the first roller and biased to provide a substantially same closing force at the opposite ends of the first roller so as to maintain a uniform closing pressure independent of the drive assembly between the ends of the first roller and the second roller when the first roller is in the closed position; and wherein the drive assembly includes a pair of drive cams configured to rotate in tandem about an axis, each drive cam configured to engage a different one of the pair of idler cams and to cause the idler cams to rotate so as to move the first roller between the open position and the closed position, wherein the pair of drive cams disengages the pair of idler cams when the first roller is in the closed position.

9. The actuator system of claim 8, wherein the each of the drive cams include a cam dwell in contact with the corresponding idler cam when the first roller is in the open position.

10. The actuator system of claim 8, wherein the drive assembly further comprises:

a drive shaft, wherein the pair of drive cams are axially mounted proximate to opposite ends of the drive shaft; and a motor configured to turn the drive shaft.

11. The actuator system of claim 10, wherein the pair of drive cams are keyed to the drive shaft such that the drive cams are radially aligned with one another relative to the drive shaft.

* * * * *